United States Patent [19]

Mozley

[11] 4,251,358

[45] Feb. 17, 1981

[54] SAND SEPARATOR

[75] Inventor: Richard H. Mozley, Falmouth, England

[73] Assignee: National Research Development Corporation, London, England

[21] Appl. No.: 42,335

[22] Filed: May 25, 1979

Related U.S. Application Data

[63] Continuation-in-part of Ser. No. 888,994, Mar. 22, 1978, abandoned.

[30] Foreign Application Priority Data

Mar. 25, 1977 [GB] United Kingdom ..... 12655/77
May 31, 1978 [GB] United Kingdom ..... 25900/78

[51] Int. Cl.[3] ..... B03B 5/04
[52] U.S. Cl. ..... 209/437; 209/504
[58] Field of Search ..... 209/443, 437, 504, 503, 209/491, 471, 440–442

[56] References Cited

U.S. PATENT DOCUMENTS

| | | | |
|---|---|---|---|
| 2,242,562 | 5/1941 | Weber | 209/441 |
| 2,358,876 | 9/1944 | Overstrom | 209/504 X |
| 2,577,565 | 12/1951 | Bradley | 209/441 X |

FOREIGN PATENT DOCUMENTS

| | | | |
|---|---|---|---|
| 242822 | 1/1912 | Fed. Rep. of Germany | 209/504 |
| 118074 | 8/1918 | United Kingdom . | |

*Primary Examiner*—Ralph J. Hill
*Attorney, Agent, or Firm*—Cushman, Darby & Cushman

[57] ABSTRACT

A sand separator has two sloping decks. Each receives a sand suspension for separation, and both are continuously smoothly reciprocated horizontally, transversely to the slope direction. The separator follows a cycle of operations whereby sand suspension is fed to each deck in turn, is separated by the reciprocation and is flushed off to bins collecting separate time-intervals of flushings.

15 Claims, 7 Drawing Figures

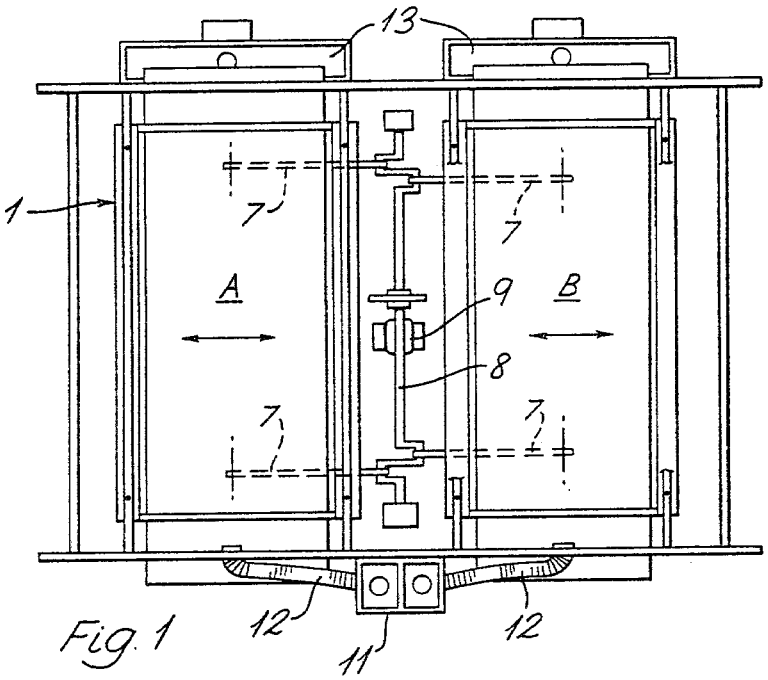
Fig. 1
Fig. 2
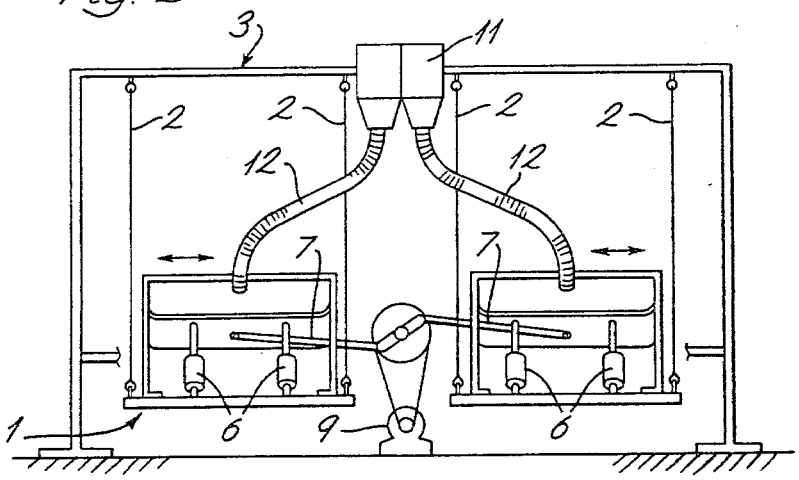

2
2
1
12a
12
40
12
40
6
13a
13b
9

SAND SEPARATOR

CROSS-REFERENCE TO RELATED APPLICATION

This application is a continuation-in-part of my earlier application Ser. No. 888,994 filed Mar. 22, 1978 now abandoned.

BACKGROUND OF THE INVENTION

This invention relates to a separator for separating particles of different densities, by treatment of suspensions of the particles in a liquid, and concerns separation of suspensions containing material distributed over a range of density and/or particle size. The invention is especially concerned with the treatment of suspended material of very small particle size such as for example, sand tailings from mineral dressing equipment which tailings in current practice are normally discharged to waste even though they contain valuable metalliferous components. For example, sand tailings from a typical mill might range from 20 British Standard mesh to 400 mesh with small proportions even finer.

In commonly owned U.K. Pat. No. 1,174,405, there is described a gravity separator which was developed primarily to handle tin bearing slimes to recover residual tin which at that time could not be recovered with existing equipment of conventional type. Apparatus in accordance with U.K. Pat. No. 1,174,405 has been available and extensively used for some years and has given excellent performance enabling very considerable savings to be made in the tin mining and other industries. The principle of operation of the apparatus of U.K. Pat. No. 1,174,405 is that of adjusting shear conditions in a flowing suspension by applying a shaking motion of variable amplitude and frequency in order to cause the heavier material to remain on a moving surface, and form a close packed deposit or bank, while the finer particles remain in suspension and advance along the surface. The decks are freely suspended and are moved by a vibratory shaking action using an unbalanced-weight drive which, although simple and reliable, is such that the path traced out by the decks with a given weight rotating at fixed radius will undesirably vary according to the total shaken weight. In certain applications, it has also become necessary to employ lower frequencies and then, particularly when the frequency employed approaches the natural frequency of the apparatus, control problems can arise.

DETAILED DESCRIPTION OF THE INVENTION

According to the present invention, a separator for particles of differing densities has all the following features (a) to (e):

(a) two sloping surfaces, each have a supply to their upper regions of particles to be separated, in the form of a flowing suspension in a liquid;

(b) the two surfaces are preferably mounted side-by-side with their sloping directions parallel and are arranged to perform a repetitious, non-discontinuous horizontal motion generally orthogonal to their slope, however the sloping directions can be in a line, the upper edges adjacent the surfaces sloping downwardly away from each other;

(c) the lower ends of the surfaces drain into separate collecting arrangements, or in an alternative arrangement the lower ends of the surfaces have a gutter attached to their respective surface, these gutters draining into a tailings collection means;

(d) the motion is imparted to the surfaces by a positive drive causing the motion to follow a path independent of the weight on the surfaces; and (e) the separator is arranged to follow a cycle of operations, with the motion applied to the surfaces throughout, in a first phase of which one surface is receiving the suspension while the other surface receives at a comparable rate the suspending liquid without particles, followed by a change in shear conditions on that other surface to flush off the particles still remaining on it, the second phase being a reversal of roles of the surfaces, the two phases alternating, the collecting arrangements separating different time-intervals of particles draining into them. The change in shear conditions may also occur when the surface is tilted the line on which the surface pivots is parallel to the sloping direction. In this arrangement the collecting means are positioned along the lower edge of the surface when it is tilted. The collecting means are partitioned to collect separately particles which at the instant of tilting have traveled different distances down the sloping direction.

Thus, in general terms, the present invention provides a gravity separator designed to apply an oscillatory motion in a transverse direction relative to the progressive movement down a slope of a flowing suspension and capable of operating at high amplitudes, e.g. in the range of at least 1 cm and possibly as large as 20 cm or more, and preferably from 4 to 18 cm, for example 5 to 15 cm, or 6 to 12 cm.

The apparatus of the present invention comprises two sloping separating surfaces each receiving material to be treated, hereinafter termed decks, mounted side-by-side and arranged to perform a repetitious, non-discontinuous horizontal motion e.g. linear, orbital or other oscillatory motion, and preferably simply harmonic motion, in a generally transverse direction relative to the slope of the deck. Jerky motion must be avoided. The decks are driven by a positive drive which causes their motion to follow a path independent of the weight of material deposited on them from the suspension being treated. The positive drive also avoids problems of loss of control at lower frequencies.

In the gravity separator according to the present invention the cycle of operations is so organized that at any one time one of the decks is functioning as a collecting surface on which banking of heavy deposits is taking place, while on the other deck previously banked material is being further separated and is then removed by alteration of the shear conditions thereon to cause banked material to be resuspended in a stream of washing liquid. Consequently, the novel apparatus includes means for adjusting the shear conditions on each of the decks, preferably by alteration of slope and/or by adjustment of amplitude and/or by adjusting frequency of oscillation. Adjusting frequency of oscillation may be accomplished for example by interchangeable drive belts or a gearbox. The simplest arrangement is one in which the two decks share a common subframe and thus are driven by a common drive means and shear conditions are altered by adjustment of slope. However, because the two decks are operated for the most part in sequence, they may be arranged to be driven independently thus giving more flexibility in selecting running conditions, e.g. amplitude and frequency. To save floor space, one may replace each deck with a stack of decks, say 4 or 6, fixed on top of each other, each receiving its own supply of material to be treated, but each discharging into a drain common to that stack.

The slope, when running as a collecting surface, is preferably within the range 1.3° to 2.5°, more preferably 1.5° to 2.2°, most preferably 1.6° to 2°. The frequency of oscillation is preferably within the range of 0.8 to 3 Hz and more preferably 1.5 to 2 Hz. If the step of flushing, that is the removal of banked solids, entails altering the slope, the slope then may be 10° to 60°, e.g. 30° to 45°.

BRIEF DESCRIPTION OF THE DRAWINGS

The present invention will now be described with reference to the accompanying drawings, in which FIG. 1 is a plan view, FIG. 2 an elevation and FIG. 3 an end elevation of one embodiment of a separator according to the present invention;

DETAILED DESCRIPTION OF THE DRAWINGS

Figure 3:
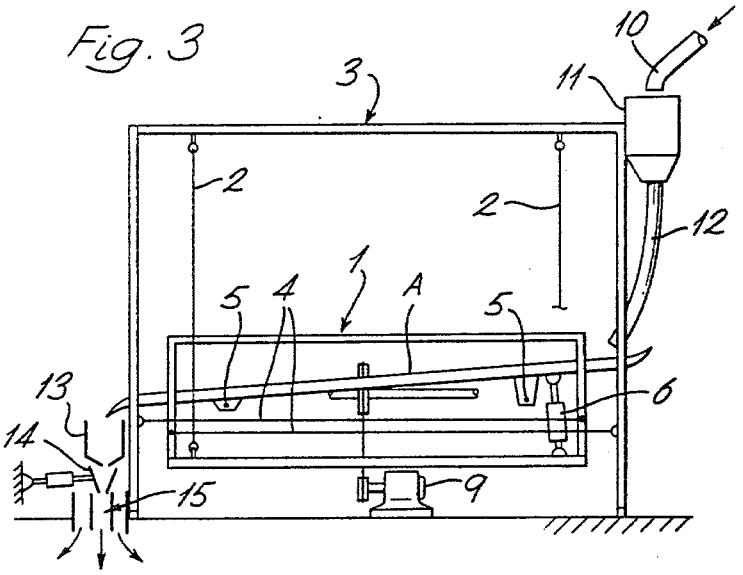

With reference to FIGS. 1–3, the separator comprises two plane decks A and B of width 1.5 m and of length 1.2 m and with upturned side edges. The decks A and B are mounted side by side on support sub-frames 1 suspended by vertical support wires 2 from a support frame 3. A single subframe 1 common to both decks is also possible. If under certain operating conditions there appears a tendency for the wires 2 to spring or slacken cyclically, causing the decks to bounce, the wires can be augmented or replaced by floor-mounted pneumatic stiffening rocking struts. Horizontal longitudinal restraining wires 4 also connect the sub-frames 1 to the support frame 3 so that the sub-frame 1, and hence the decks, cannot move in the longitudinal direction. The wires 4 may be augmented or replaced by transverse rails welded to the subframes 1, the rails running between floor-mounted roller guides. The decks A and B are mounted on pivots 5 and are adjustable in slope by means of tilt pistons 6.

The decks are driven by a common drive comprising pusher rods 7 driven by a cranked drive shaft 8 off a motor 9.

At the top end of the sloping decks, shown on the right in FIG. 3, is mounted a suspension feed device comprising a feed pipe 10 supplying a two compartment feedbox 11 leading through flexible ducting 12 to the top ends of the decks A and B.

At the bottom end of the decks, receiving material flowing off the bottom of each deck, is a drain in the form of a funnel 13 feeding through a splitter device 14 into appropriate channels 15 for the further disposition of concentrate, middlings and tailings.

In typical operation, a suspension of tin-bearing sand is initially fed into one compartment of the feedbox 11 and hence to the upper end of deck A which is oscillated with appropriate frequency, amplitude and slope to collect or bank a deposit of material comprised of the particles of a higher density.

Suitable conditions, as a guide, have been found to be as follows, subject to the finding that the wider the deck, the larger should be the amplitude and the slower the frequency.

| Particle size to be collected | Frequency | Amplitude | Slope |
|---|---|---|---|
| finer than 300 mesh BS | 1.72Hz | 7.5cm | 1.75° |
| coarser than 50 mesh BS | 1.10Hz | 14–15cm | 1.75° |

In general, the finer the particles, the higher the frequency and the lower the amplitude.

Perhaps 10% of the solids feed may thus be banked until a reasonable thickness of bank, perhaps 0.5 cm – 2 cm thick, is built up. The feed is next diverted through the second compartment of feedbox 11 to the upper edge of deck B which then starts operating in the manner just described for the first deck. Meanwhile, wash water is supplied to deck A, which continues at the previous frequency, amplitude and slope, and the splitter 14 is set first to direct the product of deck A to tails, then when the grade of the deck A product approaches the feed grade it may be directed to middlings, and to deck B optionally fitted with thickening by a cyclone. Wash water flow and feed flow as well may be adjusted for optimum performance, and are preferably from 1 to 2 liters per minute, for example 1.5 l/m.

The third phase of the cyclical operation is the discharge of the banked, washed concentrate on deck A into its drain. This is achieved by operating the tilt pistons for deck A to increase the slope from say 1.75° to 40° and adjusting the flow of wash water until the banked material is effectively dislodged on the deck which is to say flushed off, and passes through the splitter device to recovery. Other ways of removing the concentrate would be by greatly increasing the frequency, the amplitude, or both. A typical repeated cycle may involve a time period of 6 to 10 minutes, possibly 8 minutes throughout which frequency and amplitude conveniently remain unchaged, as follows:

| Time (minutes) | Deck A | Deck B |
|---|---|---|
| 0–3 | supplied with feed | irrigated with wash water |
| 3–4 | supplied with feed | deck slope increased and concentrate flushed off |
| 4–7 | irrigated with wash water | deck restored to slight slope and supplied with feed |
| 7–8 | deck slope increased and concentrate flushed off. Deck restored to slight slope. | feed supply continues |

Figure 4:
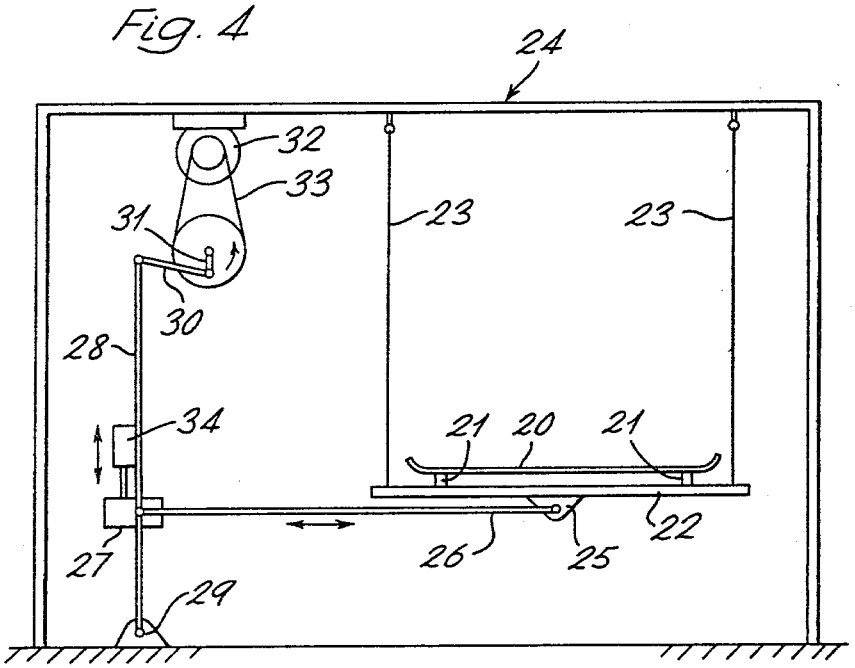
FIG. 4 is an elevation of part of a second embodiment.

Referring now to FIG. 4, this drawing shows one arrangement for varying the amplitude of oscillation. The deck 20 is supported by tilt mechanisms 21 on a sub-frame 22 which is suspended by suspension wires 23 from a support frame 24. Fixed to the sub-frame 22 is a bracket 25 to which there is attached a connecting rod 26 which actuates the sub-frame 22 to perform a linear reciprocating motion. The connecting rod 26 is secured at its other end to a block 27 which is slidable along an arm 28 connected at its lower end to a fixed pivot 29. At its upper end the arm 28 is hinged to a link 30 which is connected to a crank 31. The crank 31 is driven by means of a variable speed 750W motor 32 through a belt drive arrangement indicated generally by reference numeral 33. The motor 32 is secured to the support frame 24. Block 27 is movable along the arm 28 by means of a pneumatic cylinder and piston assembly 34.

In operation, the arm 28 performs an oscillatory angular movement about the fixed pivot 29 and therefore the throw of the connecting rod 26 and hence the amplitude of movement of the deck 20 is dependent upon the position of the block 27 on the arm 28. The above arrangement can be duplicated for each deck and the other deck (not shown) can therefore be independently varied as regards amplitude and frequency of oscillation through its own independent drive system. Variation of amplitude can be achieved through operation of the piston and cylinder assembly 34 without stopping operation of the equipment.

Initiation of the changeovers every few minutes may be by linked pneumatic timers such as with variable pneumatic timers which may be variable to permit variation of the total cycle time and the individual components of it.

Figure 5:
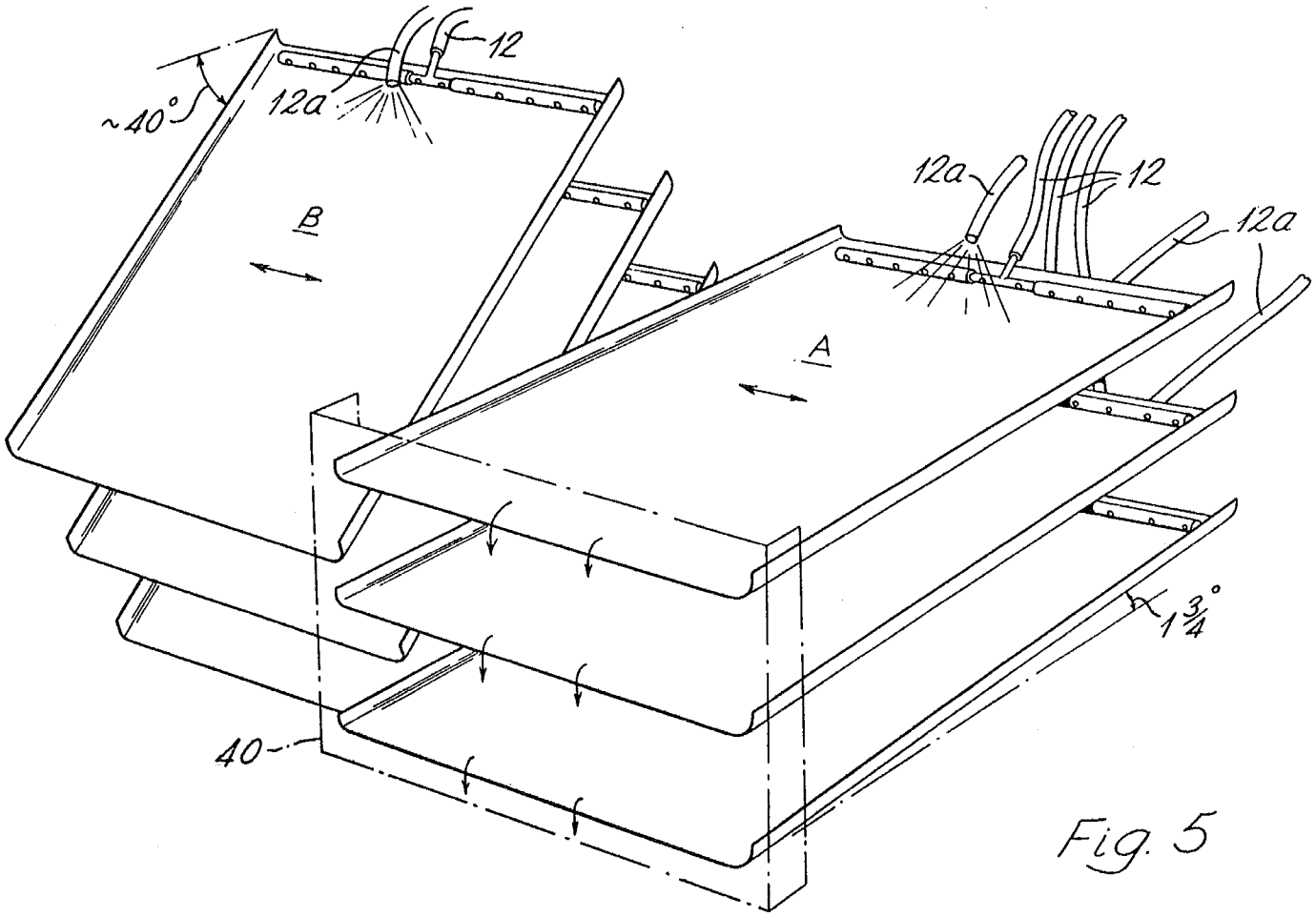
FIG. 5 is a perspective schematic view of a third embodiment.
Figure 6:
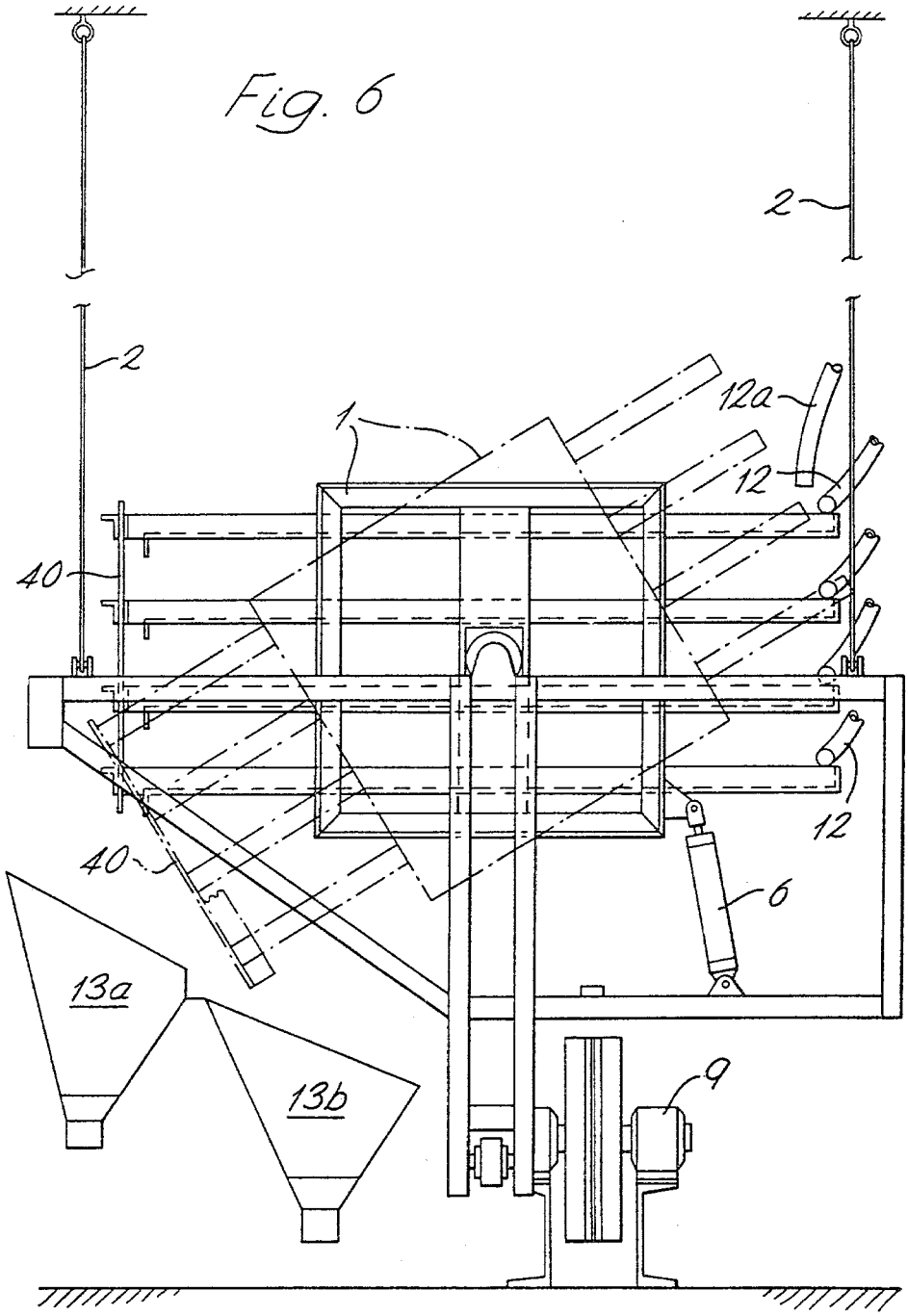
FIG. 6 is an end elevation of the embodiment of FIG. 5, in its rest position.

Instead of single decks A and B, vertically stacked banks of decks A and B are envisaged to provide increased throughput, as in FIGS. 5 and 6. Each deck has its own materials feed 12, and the clean-water feed for wash water and also for flushing is separately fed through individual flexible tubes 12*a*. Feed 12*a* need only be to a single point in the upper region of each deck. Feed 12 is distributed over the width of each deck, but that it is always suspension, not alternating with clean water, gives advantages in switching and in keeping issuing jets unblocked.

All the decks in a bank drain via a collecting board 40 common to that one bank into one of two funnels 13*a*, 13*b* depending on the deck slope.

According to another aspect of my invention advantage is made of the various densities of particles as they separate out and travel down the slope. In order to fully exploit this phenomenon the separator can be modified in several different ways, including:

With respect to feature (b) mentioned above, the sloping directions may be in line, the upper edges being adjacent and the surfaces sloping downwardly away from each other. Also the sloping directions can be arranged side-by-side as shown in FIGS. 1–2. Regarding feature (c), the lower ends of the surfaces may, instead, each have a gutter affixed to its respective surface, the gutters draining into trailings collection means. The resulting modification to feature (c) regards a change in shear conditions such that when the surface is tilted the line on which the surface pivots is parallel to the sloping direction. The collecting arrangements in this embodiment are not arranged to separate different time-intervals of particles, but lie alongside the tilted lower edge of each surface parallel to the sloping direction and are partitioned to collect separate particles which at the instant of tilting have travelled different distances down the sloping direction.

Preferably, each surface has full-length riffles substantially parallel to the horizontal motion and it is also preferred that the riffles be in groups separated along the sloping direction by unriffled portions of the surface. Preferably the partiotioning of the collecting arrangements corresponds with the grouping of the riffles. The riffles may be one-quarter to one-eighth inch wide by 10 to 100 thousandths of an inch high, spaced apart by 1 to 3 inches. This embodiment of the invention will now be discussed by way of example. In this example the words "slope" and "tilt" are throughout used to designate different directions.

Figure 7:
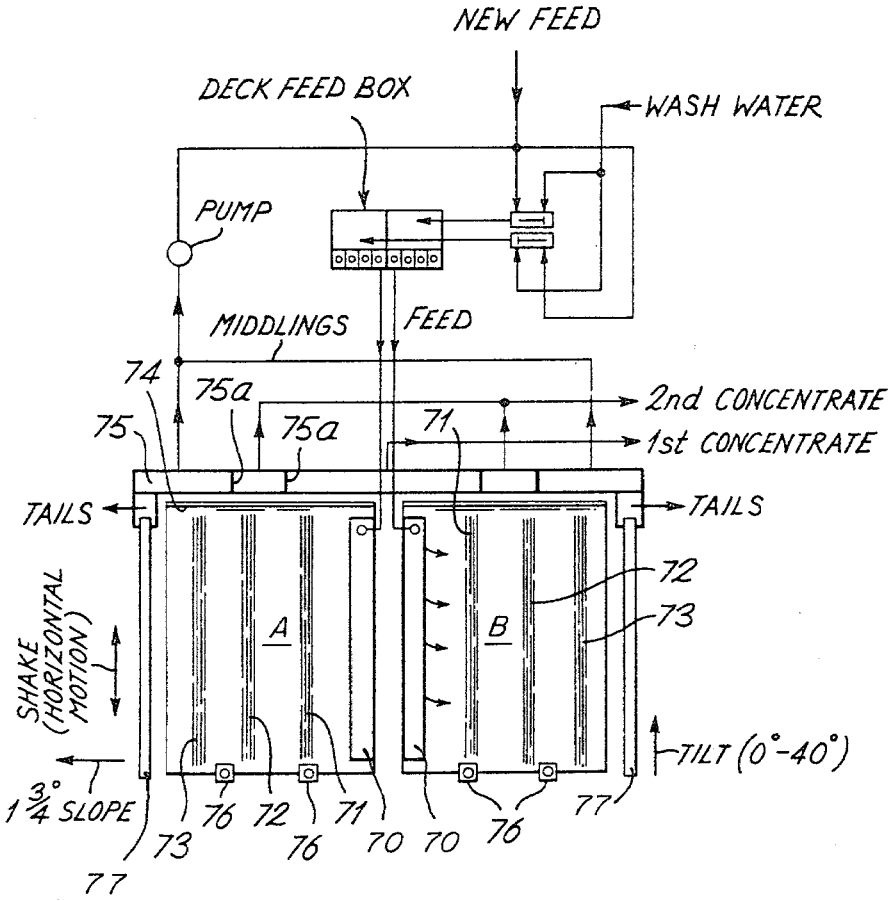
FIG. 7 is a top plan view of an embodiment in which shear conditions are changed by tilting the surface in a direction parallel to the sloping direction.

In FIG. 7 the separator includes two plane decks A and B each having an upturned side edge and downturned side edge. The sloping directions are in a line, the upper edges being adjacent and the surfaces sloping downwardly away from each other. The two surfaces are mounted on support sub-frames suspended by vertical support wires from a support frame (not shown); the decks are supported in much the same manner as in FIGS. 1–4. Decks A and B are mounted on pivots and are adjustable in slope by means of piston 76. The decks are driven in a horizontal direction, that is to say back and forth in the direction of the flow of the fluid material directed thereover. Drive means, motor and pusher rods are as in FIGS. 1–3.

At the top of the sloping decks a suspension feed device is provided including a feed pipe supplying a two compartment feedbox 70 which distributes the suspension and flushing water to the decks as may be required. The decks are characteized by an upturned edge adjacent the suspension and flushing water end and a downturned edge adjacent the collecting end. A plurality of riffles 71, 72, 73 are provided on each deck, the dimensions and positioning described in more detail below. Preferably the riffles are arranged in the direction of the wash water and concentrate flow.

At the bottom end of the decks, receiving material flowing off the bottom of each deck a collection box of launder 75 is fitted, preferably divided into various compartments 75*a* for further classification, collection and disposition of concentrate, middlings and tailings.

In the embodiment shown in FIG. 7 the incoming feed is distributed along the sides of the decks, with respect to the pivots and tilt pistons 76 and the feed is distributed over the surfaces and selectively, depending upon particle size, over the riffles 71, 72 and 73. A slight slope, say of 1.75°, is provided between the feed distribution point 70 and a perimeter collection means 77 is provided adjacent the outside edge for collecting tailings and the like. It is preferred that wash water is applied to the decks in the fully tilted position. The wash water spray bar may travel with the tiltable deck or be fixed to supply wash water when the deck is at the appropriate incline.

With the sideways tilting embodiment it is preferred to use riffles which do assist and may be in say three groups 3–5, the groups being positioned to retain high-grade concentrate for which relatively low riffles 71, e.g. 30 thou high, are suitable, medium-grade concentrate using slightly higher riffles 72 and middlings 73, respectively. The riffles generally should be slightly higher than the coarsest particles to be collected thereat.

A sideways flushing water supply is of course provided to allow the particles to be rinsed off when the surface is tilted, to say 40°, consequent on which the upturned lips at the edges of the surfaces parallel to the sloping direction should be of a somewhat smaller angle of upturn, say 30°.

The launder which collects the particles during the sideways tilting is partitioned corresponding to and in register with the above groups of riffles. The launder may either be common to both surface or stacks with separate feeds of flushing water, or the feeds may be common, with separate launders. Where the whole surface is riffled, the partitioning of the launders may be adjustable, so that fractions of any desired range of characteristics may be collected separately.

The change in shear conditions may be a rapid tilt perpendicular to the sloping direction, additional suspending fluid being applied along the side which has been tilted up. The 1.75° slope interfers relatively little if the tile is around 40°, and may thus conveniently be left alone.

With respect to the riffles, there are applied to the deck surfaces and extend the full length parallel to the direction of horizontal motion. Their height and spacing are related to the feed characteristics but are usually grouped as above. Their heights and widths are as described above. The riffles spacing, conveniently 2", and the number of riffles in each group are chosen to provide sufficient catchment appropriate to the amount of liberated or free heavies arriving on the surface during a feed period.

Riffle size and spacing is varied, the riffle dimensions being tailored to their proposed function. The second group of riffles may, for example, be required to reproduce the dimensions of the first group and be of the same height and spacing, or they may be successively higher down the slope to catch the intermediate density particles which are usually of larger size. Using this specific embodiment, the tilt now being sideways it is now possible to collect separately particles of different grades so as to equal the performance of a shaking table in which high grade products are made. According to the first described embodiment, using an increase in the tilt used in the feed cycle all the products discharged over the same lip and particles of different grades are mixed together.

Each feature of any one of the embodiments shown may be adapted for use in relation to any of the other embodiments.

What is claimed is:

1. A method of separating particles of different densities, comprising the steps of:

(1) supplying a flowing suspension of the particles in a liquid to the upper regions of the decks of a separator comprising means for supplying particles to be separated, in the form of a flowing suspension in a liquid to two sloping surfaces; means for mounting said two sloping surfaces side-by-side with their sloping directions parallel and arranged to perform a repetitious, non-discontinuous horizontal motion generally orthogonal to their slope; means for draining the lower ends of said sloping surfaces into separate collecting means; and means for imparting said horizontal motion to said sloping surfaces by a positive drive means causing the motion to follow a path independent of the weight on the surfaces and applying said motion to said sloping surface in a first phase during which one surface receives the suspension containing the particles to be separated while the other surface receives at a comparable rate the suspending liquid without particles, followed by a change in shear conditions on said other surface to flush off the particles still remaining on it, and a second phase during which said surfaces reverse roles, the two phases alternating, so that the collecting means separate different time-intervals of particles draining into them;

(2) causing the decks to perform a repetitious, smooth horizontal motion generally orthogonal to their slope, and (3) causing the separator to follow a cycle of operations, with the motion applied to the surfaces throughout, in a first phase of which one surface is receiving the suspension while the other surface receives at a comparable rate the suspending liquid without particles, followed by a change in shear conditions on that other surface to flush off the particles still remaining on it, the second phase being a reversal of roles of the surfaces, the two phases alternating, the collecting arrangements separating different time-intervals of particles draining into them.

2. The separation method according to claim 1 wherein said horizontal motion has an amplitude of at least 1 cm.

3. The separation method according to claim 2 wherein said horizontal motion has an amplitude of 20 cm or more.

4. The separation method according to claim 1 wherein a simple harmonic horizontal motion is applied to said sloping surfaces.

5. The separation method according to claim 1 including changing said shear conditions by increasing the slope of the two sloping surfaces.

6. The separation method according to claim 1 wherein the slope of said two sloping surfaces is adjusted from 1.3° to 2.5° when receiving the suspension and suspending liquid.

7. The separation method according to claim 1 wherein the frequency of the horizontal motion is from 1.5 to 2 Hz.

8. The separation method according to claim 1 wherein said horizontal motion has an amplitude of from 5 to 18 cm., the frequency of the motion is from 0.8 to 3 Hz to said sloping surfaces and the slope of the surfaces is from 1.6° to 2°.

9. A method of separating particles of differing densities, comprising the steps of:

(1) supplying a flowing suspension of the particles in a liquid to the upper regions of the decks of a separator comprising means for supplying particles to be separated, in the form of a flowing suspension in a liquid to two sloping surfaces; means for pivotably mounting said two sloping surfaces with their sloping directions in line, the upper surfaces being adjacent and the surfaces sloping downwardly and away from each other and arranged to perform a repetitious nondiscontinuous horizontal motion generally orthogonal to their slope; means attached to each of said sloping surfaces for draining the sides of said sloping surfaces into a collecting means; means attached to the lower ends of said sloping surfaces for collecting the separated particles into partitioned collection means; and means for imparting said horizontal motion to said sloping surfaces by a positive drive means causing the motion to follow a path independent of the weight on the surfaces and applying said motion to said sloping surfaces by changing the shear conditions, such that when the surface is tilted, the line on which the surface tilts is parallel to the direction of the slope;

(2) causing the decks to perform a repetitious smooth horizontal motion generally orthogonal to their slope, the particles thereon traveling different distances down the sloping direction of said surfaces, (3) causing the separator to follow a cycle of operations, with the motion applied to the surfaces throughout, particles thereon of different densities travel different distances down the sloping direction of said sloped surfaces; and (4) pivoting each of said sloped surfaces is a direction perpendicular to said slope thereby collecting separately the particles which have traveled different distances down the sloping direction.

10. The separation method according to claim 9 wherein each sloping surface has thereon a plurality of full-length riffles substantially parallel to the horizontal motion.

11. The separation method according to claim 10 wherein the slope of said two sloping surfaces is in the range of about 1.3° to 2.5°.

12. The separation method according to claim 10 wherein each of said sloping surfaces is tilted and pivoted to an angle in the range of 20° to 60° thereby removing therefrom the thus-separated particles.

13. The separation method according to claim 9 where said horizontal motion has an amplitude of 20 cm. or more.

14. The separation method according to claims 10 wherein said riffles are positioned in groups separated along the sloping direction by unriffled portions of the surface.

15. The separation method according to claim 14 wherein the partitioning of the collecting means corresponds with the grouping of the riffles.

* * * * *